US009098033B2

(12) United States Patent
Shimura

(10) Patent No.: US 9,098,033 B2
(45) Date of Patent: Aug. 4, 2015

(54) HEATER AND IMAGE HEATING DEVICE HAVING SAME HEATER

(75) Inventor: Yasuhiro Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/004,088

(22) PCT Filed: Mar. 5, 2012

(86) PCT No.: PCT/JP2012/001499

§ 371 (c)(1),
(2), (4) Date: Sep. 9, 2013

(87) PCT Pub. No.: WO2012/120867

PCT Pub. Date: Sep. 13, 2012

(65) Prior Publication Data

US 2013/0343790 A1 Dec. 26, 2013

(30) Foreign Application Priority Data

Mar. 10, 2011 (JP) ..... 2011-053298

(51) Int. Cl.

| | |
|---|---|
| ***G03G 15/20*** | (2006.01) |
| ***H05B 3/03*** | (2006.01) |
| ***H05B 3/10*** | (2006.01) |
| ***H05B 3/26*** | (2006.01) |
| *H05B 3/06* | (2006.01) |

(52) U.S. Cl.

CPC ..... *G03G 15/2053* (2013.01); *G03G 15/2042* (2013.01); *H05B 3/26* (2013.01); *H05B 3/06* (2013.01); *H05B 2203/007* (2013.01); *H05B 2203/011* (2013.01); *H05B 2203/016* (2013.01)

(58) Field of Classification Search

None

See application file for complete search history.

(56) References Cited

U.S. PATENT DOCUMENTS

| | | | | |
|---|---|---|---|---|
| 6,084,208 | A * | 7/2000 | Okuda et al. | 219/216 |
| 6,456,819 | B1 * | 9/2002 | Abe et al. | 399/329 |
| 8,126,383 | B2 * | 2/2012 | Kagawa | 399/329 |
| 8,150,304 | B2 * | 4/2012 | Kagawa et al. | 399/329 |
| 8,295,753 | B2 * | 10/2012 | Kagawa | 399/329 |
| 8,642,927 | B2 * | 2/2014 | Shimura | 219/216 |

(Continued)

FOREIGN PATENT DOCUMENTS

| | | |
|---|---|---|
| JP | 10-177319 A | 6/1998 |
| JP | 2005-209493 A | 8/2005 |

(Continued)

OTHER PUBLICATIONS

JP 10-177319A, Jun. 1998, Yamazaki, partial translation.*

(Continued)

*Primary Examiner* — Joseph M Pelham

(74) *Attorney, Agent, or Firm* — Canon USA Inc IP Division

(57) ABSTRACT

The present invention is directed to providing a heater in which uniformity of a temperature distribution in a widthwise direction of the heater can be improved while inhibiting a temperature rise of a non-sheet-passing part, and an image heating device equipped with the heater. In a first heat-generation line and a second heat-generation line, a plurality of heat-generation resistors including positive resistance-temperature characteristics between two electro-conductive elements provided on a substrate along the lengthwise direction of the substrate are connected in parallel. The first heat-generation line and the second heat-generation line are connected in parallel.

6 Claims, 5 Drawing Sheets

(56) References Cited

U.S. PATENT DOCUMENTS

| | | | | |
|---|---|---|---|---|
| 8,653,422 | B2 * | 2/2014 | Shimura et al. | 219/216 |
| 2009/0230114 | A1 * | 9/2009 | Taniguchi et al. | 219/216 |
| 2013/0343790 | A1 * | 12/2013 | Shimura | 399/329 |
| 2013/0343791 | A1 * | 12/2013 | Shimura | 399/329 |
| 2014/0169846 | A1 * | 6/2014 | Shimura et al. | 399/329 |

FOREIGN PATENT DOCUMENTS

| | | | |
|---|---|---|---|
| JP | 2005-339840 | A | 12/2005 |
| JP | 2006-004860 | A | 1/2006 |
| JP | 2006-012444 | A | 1/2006 |
| JP | 2006-252897 | A | 9/2006 |
| JP | 2007-025474 | A | 2/2007 |
| JP | 2008-140702 | A | 6/2008 |
| JP | 4208772 | B2 | 1/2009 |
| JP | 2009-244867 | A | 10/2009 |
| JP | 2009-282335 | A | 12/2009 |
| JP | 2010-002857 | A | 1/2010 |
| JP | 2011-033939 | A | 2/2011 |

OTHER PUBLICATIONS

JP 2010-2857, Jan. 2010, Kato etal, partial translation.*

* cited by examiner

Fig. 2B
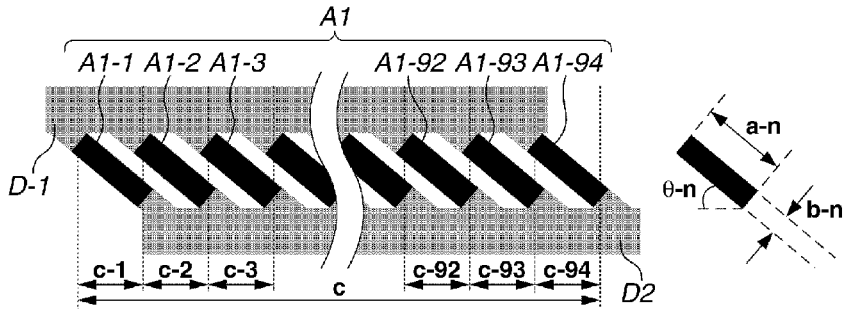
Fig. 2C
| | HEAT-GENERATING PATTERN | | | | | | | | UNIT |
|---|---|---|---|---|---|---|---|---|---|
| | 1 | 2 | ~ | 47 | 48 | ~ | 93 | 94 | |
| a (LINE LENGTH) | 3.48 | 3.48 | ~ | 3.48 | 3.48 | ~ | 3.48 | 3.48 | mm |
| b (LINE WIDTH) | 0.374 | 0.375 | ~ | 0.399 | 0.399 | ~ | 0.375 | 0.374 | mm |
| c (SPACING) | 3.16 | 3.16 | ~ | 3.16 | 3.16 | ~ | 3.16 | 3.16 | mm |
| RESISTANCE VALUE | 400 | 397 | ~ | 320 | 320 | ~ | 397 | 400 | Ω |
Fig. 3
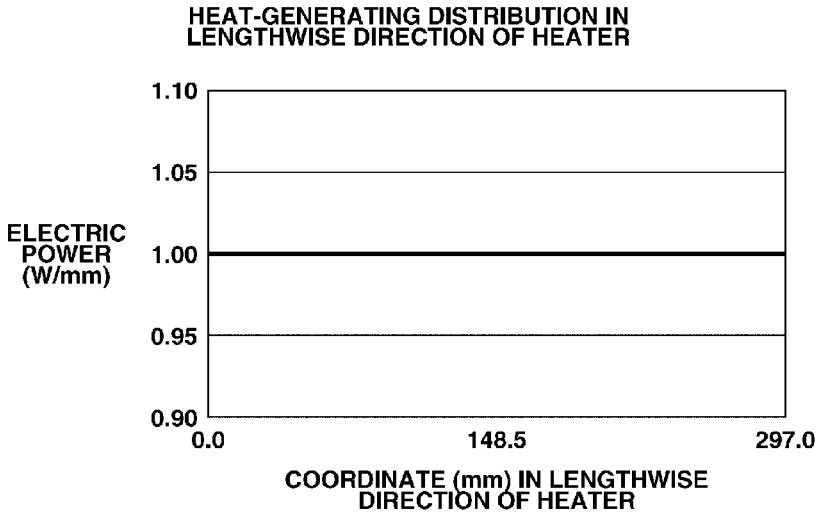

HEATER AND IMAGE HEATING DEVICE HAVING SAME HEATER

TECHNICAL FIELD

The present invention relates to a heater suitable when utilized for a heating and fixing device mounted on an image forming apparatus such as an electrophotographic copying machine, an electrophotographic printer, and to an image heating device that mounts thereon the heater.

BACKGROUND ART

As a fixing device to be mounted on a copying machine or a printer, there is available a device having an endless belt, a ceramic heater which contacts an inner surface of the endless belt, and a pressure roller which forms a fixing nip portion together with the ceramic heater via the endless belt. When small size sheets are continuously printed by an image forming apparatus that mounts thereon the fixing device, there occurs a phenomenon (non-sheet-passing part temperature rise) in which a temperature of a region through which the sheets are not passed in a lengthwise direction of fixing nip portion gradually rises. When the temperature in the non-sheet-passing part becomes too high, it may cause damages to respective parts of the device, or when printing is performed on large size sheets while the non-sheet-passing part temperature rise is occurring, toner may be subjected to high-temperature offset in a region corresponding to the non-sheet-passing part of the small size sheets.

As one of approaches for inhibiting the non-sheet-passing part temperature rise, there is a possible idea of forming the heat-generation resistors on a ceramic substrate with material having positive resistance-temperature characteristics, and arranging two electro-conductive elements on both ends in the widthwise direction of substrate so that electric current flows through the heat-generation resistors in the widthwise direction of heater (in a conveyance direction of recording sheets). The concept is such that when the non-sheet-passing part undergoes a temperature rise, resistance values of the heat-generation resistors of the non-sheet-passing part are decreased, and electric current which flow through the heat-generation resistors of the non-sheet-passing part is inhibited, thereby inhibiting heat generation of the non-sheet-passing part. Positive resistance-temperature characteristics imply characteristics in which an electrical resistance increases when temperature is raised. This is hereinafter referred to as positive temperature coefficient (PTC).

Japanese Patent Application Laid-Open No. 2005-209493 discusses a method for arranging two electro-conductive elements at both ends in a widthwise direction of substrate so that electric current flows in a widthwise direction of a heater (in a conveyance direction of recording sheets), using material having positive resistance-temperature characteristics. It was found that, with this method, when a temperature distribution occurs in the widthwise direction of heater (in a conveying direction of sheets), resistance values of the heat-generation resistors arranged in a high-temperature part in the widthwise direction increase, and as a result, heat-generation amounts of the high-temperature part in the widthwise direction increase, eventually the temperature distribution in the widthwise direction is likely to become non-uniform.

CITATION LIST

Patent Literature

PTL 1: Japanese Patent Application Laid-Open No. 2005-209493

SUMMARY OF INVENTION

The present invention is directed to improving uniformity of a temperature distribution in a widthwise direction of a heater while inhibiting a non-sheet-passing part temperature rise, in an image heating device using heat-generation resistors having positive resistance-temperature characteristics.

According to an aspect of the present invention, a heater used for an image heating device includes a substrate, a first heat-generation line including a first electro-conductive element provided on the substrate along a lengthwise direction of the substrate, a second electro-conductive element provided on the substrate along the lengthwise direction of the substrate at a position different in a widthwise direction of the substrate from the first electro-conductive element, and a plurality of heat-generation resistors including positive resistance-temperature characteristics, and electrically connected in parallel between the first electro-conductive element and the second electro-conductive element, and a second heat-generation line including a third electro-conductive element provided on the substrate along the lengthwise direction of the substrate, a fourth electro-conductive element provided on the substrate at a position different in the widthwise direction on the substrate from the third electro-conductive element, and a plurality of heat-generation resistors including positive resistance-temperature characteristics and electrically connected in parallel between the third electro-conductive element and the fourth electro-conductive element. The first heat-generation line and the second heat-generation line are provided along the lengthwise direction of the substrate at positions different in the widthwise direction of the substrate from each other, and the first heat-generation line and the second heat-generation line are electrically connected in parallel.

Further features and aspects of the present invention will become apparent from the following detailed description of exemplary embodiments with reference to the attached drawings.

BRIEF DESCRIPTION OF DRAWINGS

The accompanying drawings, which are incorporated in and constitute a part of the specification, illustrate exemplary embodiments, features, and aspects of the invention and, together with the description, serve to explain the principles of the invention.

FIG. 1 is a cross-sectional view of an image heating device according to the present invention.

FIG. 2A is a configuration view of a heater according to a first exemplary embodiment.

[FIG. 2B] FIG. 2B is a configuration view of a heater according to a first exemplary embodiment.

[FIG. 2C] FIG. 2C is a configuration view of a heater according to a first exemplary embodiment.

[FIG. 3] FIG. 3 illustrates a relationship with a sheet size of the heater according to the first exemplary embodiment.

FIG. 4 is an explanatory view for a heat-generation distribution of the heater according to the first exemplary embodiment.

FIG. 5A is an explanatory view for the effects of the heater according to the first exemplary embodiment.

FIG. 5B is an explanatory view for the effects of the heater according to the first exemplary embodiment.

FIG. 6A is a configuration view of a heater according to a second exemplary embodiment.

FIG. 6B is a configuration view of a heater according to a second exemplary embodiment.

FIG. 7 is a configuration view of a heater according to a third exemplary embodiment.

FIG. 8A is a configuration view of a heater of comparative example.

FIG. 8B is a configuration view of a heater of comparative example.

DESCRIPTION OF EMBODIMENTS

Various exemplary embodiments, features, and aspects of the invention will be described in detail below with reference to the drawings.

Figure 1:
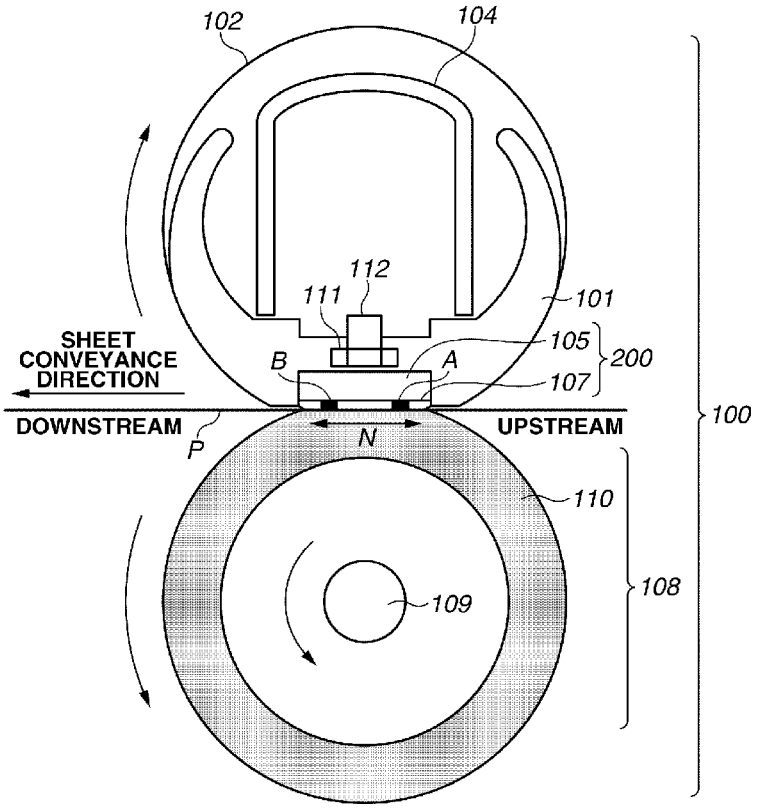
[FIG. 1]

FIG. 1 is a cross-sectional view of a fixing device 100 as an example of an image heating device. The fixing device 100 includes a cylindrical film (endless belt) 102, a heater 200 that contacts an inner surface of the film 102, and a pressure roller (nip portion forming member) 108 that forms a fixing nip portion N together with the heater 200 via the film 102. Material of a base layer of the film is a heat-resistant resin such as polyimide, or a metal such as stainless steel.

The pressure roller 108 includes a core 109 made of material such as iron or aluminum, and an elastic layer 110 made of material such as silicone rubber. The heater 200 is held by a holding member 101 made of heat-resistant resin. The holding member 101 has a guide function for guiding rotation of the film 102. The pressure roller 108 receives a power from a motor (not illustrated) and rotates in a direction of an arrow. The film 102 is driven and rotated by rotation of the pressure roller 108.

The heater 200 includes a heater substrate 105 made of ceramic, a heat-generation line A (first heat-generation line) and a heat-generation line B (second heat-generation line) that are formed using heat-generation resistors on the substrate, and an insulating (glass in the present exemplary embodiment) surface protective layer 107 that covers the heat-generation lines A and B. A temperature detection element 111 such as a thermistor abuts on a sheet-passing region of available minimum size sheets (an envelope Din Lang (DL): 110 mm width in the example) set up on a printer, on the back surface side of the heater substrate 105. Electric powers to be supplied from a commercial AC power source to heat-generation lines are controlled according to a detected temperature of the temperature detection element 111.

A recording material (paper sheet) P on which unfixed toner image is borne is heated while being sandwiched and conveyed in the fixing nip portion N and is subjected to fixing processing. A safety element 112 such as a thermo-switch also abuts on the back surface side of the heater substrate 105. The safety element 112 is actuated to shut off a feeder line to the heat-generation lines, when the heater is subjected to abnormal temperature rise. The safety element 112 also, similarly to the temperature detection element 111, abuts on the sheet-passing region of the minimum size sheets. A metallic stay 104 is used to apply pressure of a spring (not illustrated) onto the holding member 101.

The fixing device described in the example is the one to be mounted on a printer corresponding to a sheet width 297 mm when A3 size sheet (297 mm*420 mm) is fed longitudinally (conveyed so that long side becomes parallel with a conveyance direction). The fixing device is designed to be capable of corresponding to a sheet with a sheet width narrower than A3 size, i.e., width of 210 mm when A5 size (148 mm*210 mm) sheets are fed transversely.

Figure 2A:
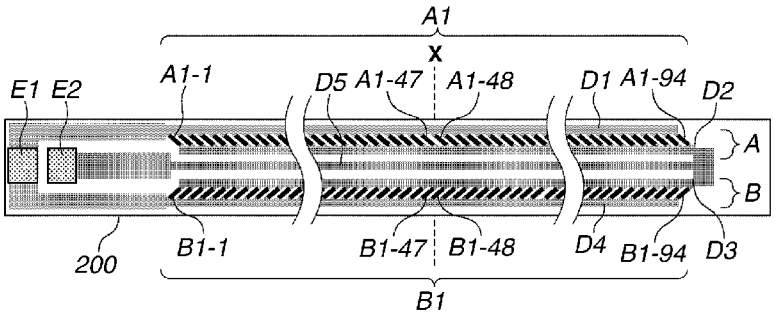
[FIG. 2A]

A first exemplary embodiment will be described. FIGS. 2A, 2B, and 2C illustrate schematic views of the heater according to the first exemplary embodiment. The heat-generation resistors in a heat-generation line A and the heat-generation resistors in the heat-generation line B each have positive resistance-temperature characteristics (PTC). The heat-generation line A (the first heat-generation line) includes one heat-generation block A1, and the heat-generation line B (the second heat-generation line) also includes one heat-generation block B1. Further, the heat-generation line A and the heat-generation line B are connected in parallel, and electric powers are supplied from electrodes E1 (first electrode) and E2 (second electrode).

The heat-generation line A includes an electro-conductive pattern D1 (first electro-conductive element of the heat-generation line A) provided along a lengthwise direction of the substrate, and an electro-conductive pattern D2 (second electro-conductive element of the heat-generation line A) provided along the lengthwise direction of the substrate at a position different in a widthwise direction of the substrate from the electro-conductive pattern D1. Between the electro-conductive pattern D1 and the electro-conductive pattern D2, a plurality of (94 pieces in the example) heat-generation resistors (A1-1 to A1-94) are electrically connected in parallel, which forms a heat-generation block A1.

The heat-generation line B includes an electro-conductive pattern D3 (third electro-conductive element of the heat-generation line B) provided along the lengthwise direction of the substrate, and an electro-conductive pattern D4 (fourth electro-conductive element of the heat-generation line B) provided along the lengthwise direction of the substrate at a position different in the widthwise direction of the substrate from the electro-conductive pattern D3. Between the electro-conductive pattern D3 and the electro-conductive pattern D4 a plurality of (94 pieces in this example) heat-generation resistors (B1-1 to B1-94) is electrically connected in parallel, which forms the heat-generation block B1.

An electro-conductive pattern (fifth electro-conductive element) D5 is arranged between the electro-conductive pattern D2 and the electro-conductive pattern D3 (inner side in the widthwise direction). The electro-conductive pattern D1 and the electro-conductive pattern D4 are connected to the electrode E1 on an electrode side (on left side of FIG. 2A) in the lengthwise direction of the substrate. The electro-conductive pattern D2 and the electro-conductive pattern D3 are connected to the electro-conductive pattern D5 on a non-electrode side (on right side of FIG. 2A) in the lengthwise direction of the substrate, and the electro-conductive pattern D5 is connected to the electrode E2 on the electrode side (on left side of FIG. 2A) in the lengthwise direction of the substrate.

Since electric powers can be supplied from both sides in the lengthwise direction of the substrate, to the heat-generation block A1 and the heat-generation block B2, by using the electro-conductive pattern D5, it is useful for obtaining the effect of improving a heat-generation distribution in the lengthwise direction of the substrate of the heater 200 described below.

By bringing the electrode E1 and the electrode E2 together in one side in the lengthwise direction, connectors (not illustrated) can be arranged only on one side in the lengthwise direction of the substrate. It is useful when electric power is supplied to the heater 200 by one connector having an electrode with two poles.

Since the electro-conductive pattern D2, the electro-conductive pattern D3, and the electro-conductive pattern D5 are maintained at electrically substantially equal potentials, when electric powers are supplied to the heater 200, it is advantageous to arrange the electro-conductive pattern D5 between the electro-conductive pattern D2 and the electro-conductive pattern D3 (inner side in the widthwise direction of the substrate). Since the electro-conductive pattern intervals (intervals of D2, D3, and D5) can be narrowed, without considering electric discharge or the like between the electro-conductive patterns, it is useful when forming a heater on the heater substrate with relatively narrow width in the widthwise direction of the substrate.

FIG. 2B illustrates a detailed view of the heat-generation block A1. Between the electro-conductive element D1 and the electro-conductive element D2, the plurality of (94 pieces in the example) heat-generation resistors (A1-1 to A1-94) is electrically connected in parallel, which forms the heat-generation block A1. The heat-generation block A1 includes 94 pieces from a heat-generation resistor A1-1 with a line length a-1, a line width b-1, and an inclination theta-1, to a heat-generation resistor A1-94 with a line length a-94, a line width b-94, and an inclination theta-94, which are aligned at intervals c-1 to c-94, and are connected in parallel via the electro-conductive elements. A heat-generation block length, as indicated by C in FIG. 2C, is defined as a length from the center of short side of the heat-generation resistor A1-1 located at left-end, to the center of short side of the heat-generation resistor A1-94 located at right-end. In the heater 200, the intervals c-1 to c-94 of the heat-generation resistors are equal intervals, which are set at c/94.

In this case, resistance values of the electro-conductive patterns D1 to D4 of the heat-generation block A1 and the heat-generation block B1 are not zero, and a voltage drop is generated by the electro-conductive elements. It has been found that, due to the influence of the voltage drop, in one heat-generation block, voltages applied to the heat-generation resistors in the central portion become smaller as compared with voltages applied to the heat-generation resistors of both end portions. Since a heat-generation amount of a heat-generation resistor is proportional to the square of applied voltage, the heat-generation amounts will become different between the central portion and the both end portions of the heat-generation block. In this manner, when heat-generation unevenness occurs in one heat-generation block, unevenness of heat-generation distribution in the lengthwise direction also becomes significant.

To inhibit the heat-generation unevenness described above, the heat-generation block A1 is designed to allow heat-generation resistors located closer to the conveyance reference X side to have lower resistance values, and to allow heat-generation resistors located closer to the end portion side of the heat-generation line A to have higher resistance values.

The table illustrated in FIG. 2C gives an example of a method for adjusting a heat-generation amount per unit length of the heat-generation block A1. In this case, a length a-n, and an interval c-n of a heat-generation resistor is made constant, and a resistance value of the heat-generation resistor in the lengthwise direction is adjusted by adjusting a line width b-n. The resistance value of the heat-generation resistor, since it is proportional to the length/line width, may be adjusted by adjusting the length of the heat-generation resistor similarly to the line width. Thus, the heat-generation line A only needs to satisfy at least either one condition out of: the heat-generation resistors arranged on end portions of the heat-generation line have higher resistance values than the heat-generation resistors arranged in the center in the lengthwise direction, or intervals of a plurality of heat-generation resistors included in one heat-generation line are wider in the end portions than in the center in the lengthwise direction.

By making a shape of the heat-generation resistors rectangular as illustrated in FIG. 2C, a distribution of electric currents which flow through the heat-generation resistors can be made uniform. In a case where the heat-generation resistors have, for example, a parallelogram shape, more electric current flows through the shortest path, and as a result, a bias may occur in the distribution of the electric currents which flow through the heat-generation resistors. However, the effect of inhibiting the non-sheet-passing part temperature rise of the present invention can be obtained even when the heat-generation resistors in the parallelogram shape are used, and the shape of the heat-generation resistors is not limited to rectangle. Alternatively, heat-generation resistors in a curved shape may be used.

Further, an attempt is made to inhibit minute unevenness of the heat-generation distribution in the lengthwise direction of the substrate by arranging adjacent heat-generation resistors to overlap each other in the lengthwise direction of the substrate. In the present exemplary embodiment, as illustrated in FIG. 2C, adjacent heat-generation resistors are arranged such that the center of short side of the heat-generation resistor and the center of short side of neighboring heat-generation resistor overlap each other. Since a method for adjusting resistance values of the heat-generation line B is similar to that of the heat-generation line A, descriptions thereof will not be repeated.

FIG. 3 illustrates a heat-generation distribution in the lengthwise direction of the heater 200. By supplying electric powers from both sides in the lengthwise direction of the substrate to the heat-generation block A1 and the heat-generation block B1, and performing a method for adjusting resistance values of the heat-generation block A1 and B1 described in FIGS. 2A, 2B, and 2C, uniformity of heat-generation distributions in the lengthwise direction of the substrate of the heater 200 can be improved.

Figure 4:
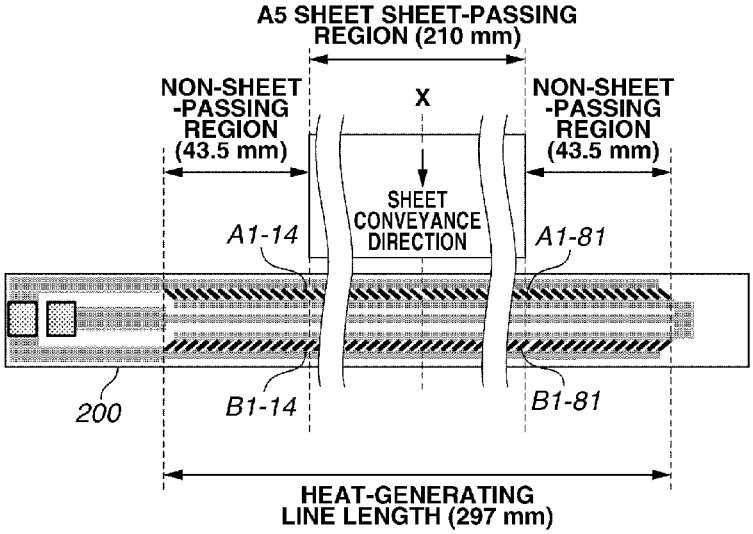
[FIG. 4]

FIG. 4 is a view for explaining the non-sheet-passing part temperature rise of the heater 200. FIG. 4 illustrates a case where A5 size sheet (210 mm*148 mm) is conveyed in the longitudinal direction with reference to the central portion of the heat-generation line as an example. A recording material (sheet) conveyance reference X is defined as a reference position when different sheets are conveyed.

A sheet feed cassette (not illustrated) includes a position regulating plate for regulating a position of the sheets, feeds the recording sheets from a predetermined position for each size of stacked recording sheets, and conveys them such that the recording sheets pass through a predetermined position of the image heating device. Although, in this example, a case where the central portion is used as the reference has been described, similarly even when sheet conveyance is performed with reference to either of right- or left-end portions, the non-sheet-passing part temperature rise occurs at an end portion on an opposite side to the reference. For example, when the sheet conveyance is performed with the left-end as a reference, the recording material (sheet) conveyance reference X is the left-end.

The heater 200 in FIG. 4, to adapt to a case where A3 size sheet (about 297 mm*420 mm) is conveyed in the longitudinal direction, has a heat-generation line length 297 mm, with respect to a sheet width 297 mm. In a case where A5 size sheet with a sheet width 210 mm (148 mm*210 mm) is conveyed in the longitudinal direction, on the heater 200 having the heat-generation line length 297 mm, the non-sheet-passing regions 43.5 mm are created at each of both end portions of the heat-generation line. A temperature control of the heater 200 is performed based on output of the thermistor 111 provided near the center of the sheet-passing part. Since heat is not drawn by the sheets at the non-sheet-passing part, temperatures of the non-sheet-passing part rise higher as compared with those of the sheet-passing part. The end portions of the A5 size sheet pass over the heat-generation resistors A1-14 and A1-81 of the heat-generation line A1. Similarly, the end portions of the A5 size sheet pass over the heat-generation resistors B1-14 and B1-81 of the heat-generation line B1. The heater 200 is a heater using the heat-generation resistors with PTC, directed to inhibiting the non-sheet-passing part temperature rise, which occurs when the small size sheet is printed as illustrated in FIG. 4.

Figure 5A:
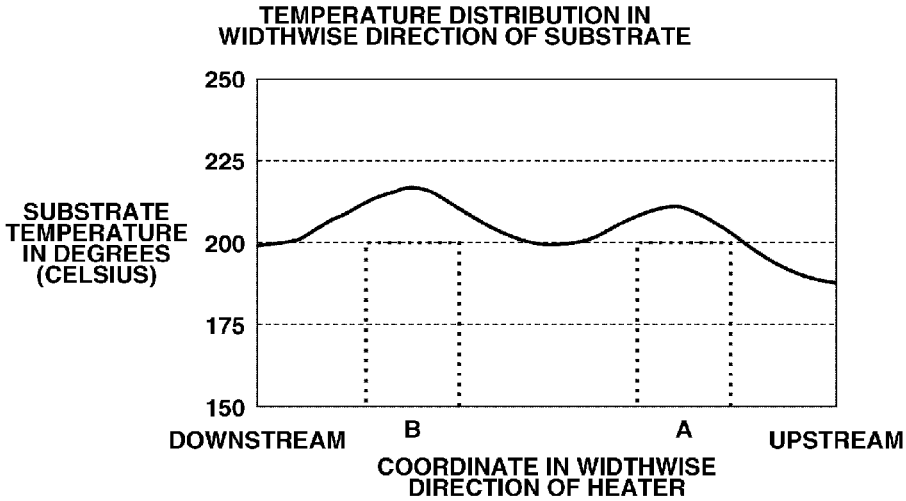
[FIG. 5A]
Figure 5B:
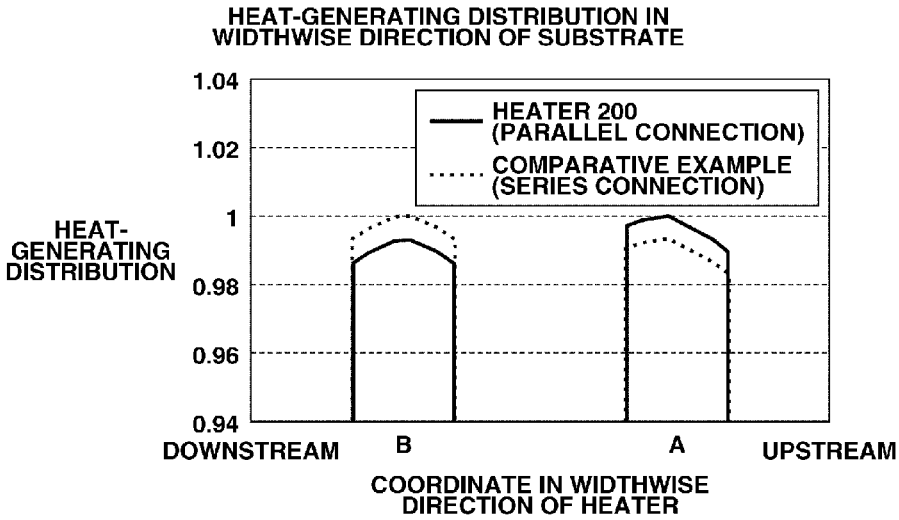
[FIG. 5B]

FIGS. 5A and 5B are views used for explaining the effect of improving uniformity of a temperature distribution in the widthwise direction of the substrate of the heater 200. FIG. 5A illustrates a temperature distribution in the widthwise direction of the substrate of the heater 200 in a state where the pressure roller 108 is rotating, such as when the recording material P is heated while being conveyed. Since rotation of the pressure roller 108 and conveyance of the sheets are performed from the upstream side towards the downstream side of the fixing device, temperatures on the downstream side in the widthwise direction of the substrate of the heater 200 are elevated.

Figure 8A:
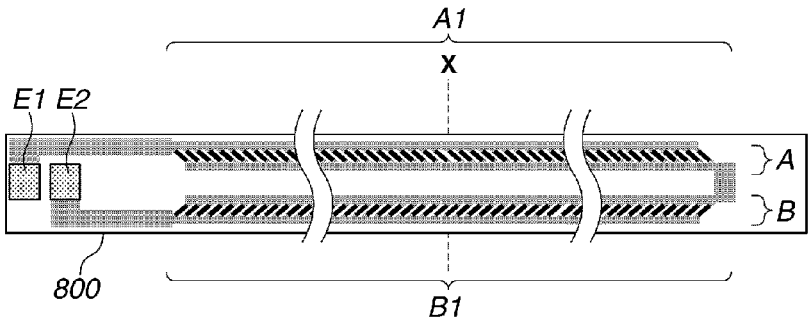
[FIG. 8A]

FIG. 5B illustrates a heat-generation distribution in the widthwise direction of the substrate of the heater 200 in the state in FIG. 5A. Further, FIG. 5B illustrates a heat-generation distribution of a heater 800 (illustrated in FIG. 8A) used as a comparative example. In the heater 800 used as the comparative example, the heat-generation line A and the heat-generation line B of the heater 200 are connected in series.

In the heater 200 according to the present exemplary embodiment, when temperatures on the upstream side (the heat-generation line A side) in the widthwise direction of the substrate become lower as compared with temperatures on the downstream side (the heat-generation line B side) in the widthwise direction of the substrate, resistance values of the heat-generation block A1 decrease. As a result, the heat-generation amounts increase higher as compared with the heat-generation block B1 connected in parallel. Since, in this manner, in the heater 200 the heat-generation amounts increase on the upstream side where temperatures have become lower, uniformity of the temperature distribution in the widthwise direction of the substrate can be improved.

In the heater 800 of the comparative example indicated by dotted lines, when the temperatures on the upstream side (the heat-generation line A side) in the widthwise direction of the substrate become lower as compared with the temperatures on the downstream side (the heat-generation line B side) in the widthwise direction of the substrate, resistance values of the heat-generation block A1 decrease. As a result, heat-generation amounts decrease lower as compared with the heat-generation block B1 connected in series. As shown in the comparative example, if the heat-generation block A1 and the heat-generation block A2 are electrically connected in series, the heat-generation amounts decrease on the upstream side where temperatures have become lower. As a result, uniformity of the temperature distribution in the widthwise direction of the substrate will be worsened.

Figure 8B:
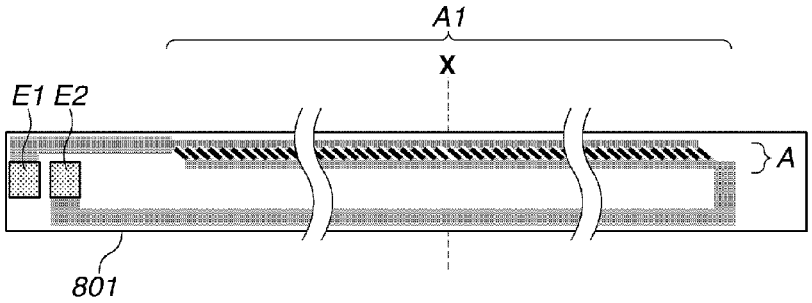
[FIG. 8B]

Here, attention is focused on only the heat-generation distribution of the heat-generation line A. It is apparent that even in one heat-generation block A1, a heat-generation amount becomes low in an area where a temperature is low, while a heat-generation amount becomes high in an area where a temperature is high. For example, even in such a heater having only the heat-generation line A as heater 801 (illustrated in FIG. 8B) of the comparative example, when a heater is arranged such that electric current flows in the widthwise direction of the heater (in the conveying direction of the recording sheet), using resistance heat-generation material with PTC, the heater has the characteristics in which uniformity of the temperature distribution in the widthwise direction of the substrate will be further worsened when a temperature distribution in the widthwise direction of the substrate occurs.

The heat-generation lines arranged such that electric current flows in the widthwise direction of the heater (in the conveying direction of the recording sheet), using the resistance heat-generation material with PTC, as illustrated in the heater 200 according to the present exemplary embodiment, are connected in parallel using a plurality of pieces (the heat-generation line A and the heat-generation line B in the present exemplary embodiment). Thereby, uniformity of the temperature distribution in the widthwise direction of the substrate can be improved, as described in FIGS. 5A and 5B.

By thus using the heater 200 according to the first exemplary embodiment, uniformity of the temperature distribution in the widthwise direction of the heater can be improved while inhibiting the non-sheet-passing part temperature rise.

Figure 6A:
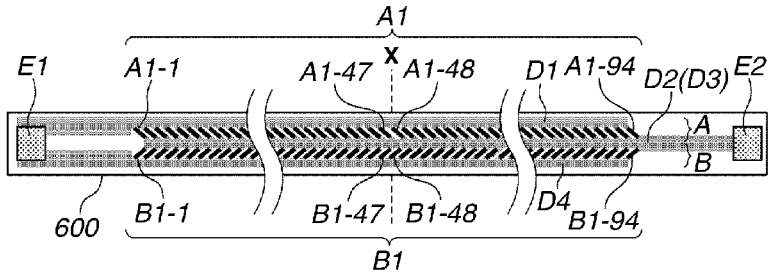
[FIG. 6A]
Figure 6B:
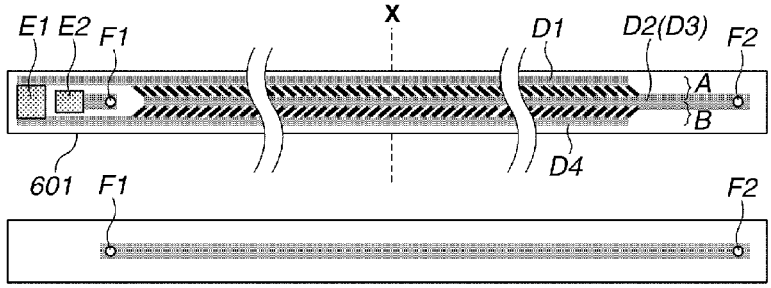
[FIG. 6B]

Next, a heater according to a second exemplary embodiment will be described. In regard to the configuration similar to that of the first exemplary embodiment, descriptions thereof will not be repeated. FIGS. 6A and 6B are schematic views for explaining a heater 600 to be used in the second exemplary embodiment. The heat-generation line A (first heat-generation line) includes one heat-generation block A1, and also the heat-generation line B (second heat-generation line) includes the heat-generation block B1. The heat-generation line A and the heat-generation line B are connected in parallel. Further, electric powers are supplied to the heat-generation line A and the heat-generation line B which are connected in parallel, via the electrode E1 and the electrode E2.

In the first exemplary embodiment, as illustrated in FIG. 2A, three electro-conductive patterns consisting of the electro-conductive pattern D3, the electro-conductive pattern D4, and the electro-conductive pattern D5 are used. The heater 600 according to the present exemplary embodiment, as illustrated in FIGS. 6A and 6B, can be formed only by one electro-conductive element D2 (D3). For this reason, the electro-conductive element D2 (D3) becomes useful heat-generation pattern, when the heater is formed on a heater substrate with a narrow width in the widthwise direction of the substrate.

The heat-generation line A has the electro-conductive pattern D1 (first electro-conductive element of the heat-generation line A) provided along the lengthwise direction of the substrate, and the electro-conductive pattern D2 (D3) (second electro-conductive element of the heat-generation line A) provided along the lengthwise direction of the substrate at a position different in the widthwise direction of substrate from the electro-conductive pattern D1.

Between the electro-conductive pattern D1 and the electro-conductive pattern D2(D3), a plurality of (94 pieces in this example) heat-generation resistors (A1-1 to A1-94) is electrically connected in parallel, which forms the heat-generation block A1.

The heat-generation line B has the electro-conductive pattern D4 (first electro-conductive element of the heat-generation line B) provided along the lengthwise direction of the substrate, and the electro-conductive pattern D2 (D3) (second electro-conductive element of the heat-generation line B) provided along the lengthwise direction of substrate at a position different in the widthwise direction of the substrate from the electro-conductive pattern D4.

Between the electro-conductive pattern D4 and the electro-conductive pattern D2 (D3), a plurality of (94 pieces in this example) heat-generation resistors (B1-1 to B1-94) is electrically connected in parallel, which forms the heat-generation block B.

Further, as illustrated in a heater 601 in FIG. 6B, through-holes F1 and F2 may be formed on the substrate, and the electrode E1 and the electrode E2 may be arranged on one side in the lengthwise direction of the substrate, via the electro-conductive pattern on a substrate back surface of the heater 601.

Also in the heater 600 according to the present exemplary embodiment, uniformity of the temperature distribution in the widthwise direction of the heater can be improved while inhibiting the non-sheet-passing part temperature rise.

Figure 7:
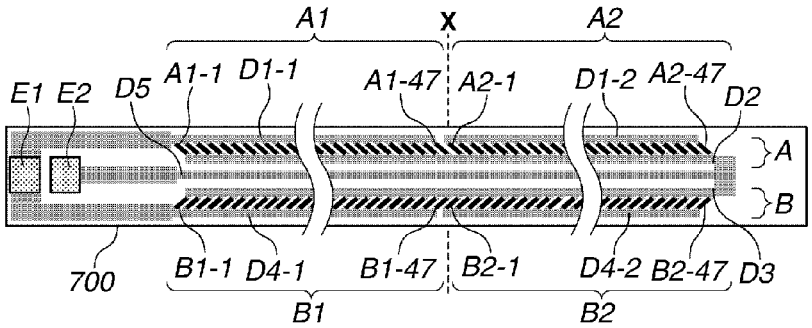
[FIG. 7]

Next, a heater according to a third exemplary embodiment will be described. In regard to the configuration similar to that in the first exemplary embodiment, descriptions thereof will not be repeated. FIG. 7 is a schematic view for explaining a heater 700 according to the third exemplary embodiment. The heat-generation line A (first heat-generation line) has two heat-generation blocks A1 and A2, and the heat-generation block A1 and A2 are connected in series. The heat-generation line B (second heat-generation line) also includes two heat-generation blocks B1 and B2, and the heat-generation block B1 and B2 are also connected in series. Further, to the heat-generation line A and the heat-generation line B which are connected in parallel, electric powers are supplied via the electrode E1 and the electrode E2. The heat-generation line A includes the electro-conductive element D1 (the first electro-conductive element of the heat-generation line A) provided along the lengthwise direction of the substrate, and the electro-conductive element D2 (the second electro-conductive element of the heat-generation line A) provided along the lengthwise direction of the substrate at a position different in the widthwise direction of the substrate from the electro-conductive element D1. The electro-conductive element D1 is divided into two lines (D1-1, D1-2) in the lengthwise direction of the substrate. Since the configuration of the heat-generation line B is similar to that in the heat-generation line A, descriptions thereof will not be repeated.

The heat-generation block A1 allows heat-generation resistors closer to the heat-generation resistors (A1-24) located on the center side of the heat-generation block to have lower resistance values, and allows heat-generation resistors closer to the heat-generation resistors (A1-1, A1-47) located on end portions side of the heat-generation block to have higher resistance values. The heat-generation block A2 allow heat-generation resistors closer to the heat-generation resistors (A2-24) located on the center side of the heat-generation block to have lower resistance values, and allow heat-generation resistors closer to the heat-generation resistors (A2-1, A2-47) located on end portions side of the heat-generation block to have higher resistance values. Since the configuration of the heat-generation line B is similar to that of the heat-generation line A, descriptions thereof will not be repeated.

Such a heater in which the heat-generation line is divided into a plurality of heat-generation blocks which are connected in series as the heater 700 according to the present exemplary embodiment, resistance heat-generation materials with relatively low sheet resistance values as compared with the heater 200 described in the first exemplary embodiment can be used.

Such a heater in which the heat-generation line is divided into a plurality of heat-generation blocks, and the heat-generation blocks within one heat-generation line are connected in series as the heater 700 according to the present exemplary embodiment, uniformity of the temperature distribution in the widthwise direction of the heater can be improved while inhibiting the non-sheet-passing part temperature rise.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-053298 filed Mar. 10, 2011, which is hereby incorporated by reference herein in its entirety.

The invention claimed is:

1. A heater used for an image heating device comprising:

a substrate having lengthwise and widthwise dimensions;

first and second electrodes provided on the substrate at the same end of the substrate in a lengthwise direction of the substrate;

a first heat-generation line including a first electro-conductive element provided on the substrate along the lengthwise direction of the substrate, a second electro-conductive element provided on the substrate along the lengthwise direction of the substrate at a position different in a widthwise direction of the substrate from the first electro-conductive element, and a plurality of heat-generation resistors including positive resistance-temperature characteristics, and electrically connected in parallel between the first electro-conductive element and the second electro-conductive element;

a second heat-generation line including a third electro-conductive element provided on the substrate along the lengthwise direction of the substrate, a fourth electro-conductive element provided on the substrate along the lengthwise direction of the substrate at a position different in the widthwise direction of the substrate from the third electro-conductive element, and a plurality of heat-generation resistors including positive resistance-temperature characteristics and electrically connected in parallel between the third electro-conductive element and the fourth electro-conductive element, and a fifth electro-conductive element provided on the substrate, wherein the second electro-conductive element and the third electro-conductive element are arranged between the first electro-conductive element and the fourth electro-conductive element in the widthwise direction of the substrate, wherein the fifth electro-conductive element is arranged between the second electro-conductive element and the third electro-conductive element in the widthwise direction of the substrate, wherein the first electrode is connected to the first electro-conductive element and the fourth electro-conductive element, wherein the second electrode is connected to the fifth electro-conductive element, wherein the second electro-conductive element and the third electro-conductive element are connected to the fifth electro-conductive element, and wherein the first heat-generation line and the second heat-generation line are provided along the lengthwise direction of the substrate at positions different in the widthwise direction of the substrate from each other, and the first heat-generation line and the second heat-generation line are electrically connected in parallel.

2. The heater according to claim 1, wherein the first and second heat-generation lines satisfy at least either one of conditions that heat-generation resistors arranged at end portions of each heat-generation line have higher resistance values than the heat-generation resistors arranged at the center in the lengthwise direction of the substrate, or the distance between adjacent heat-generation resistors included in one heat-generation line are wider at end portions than at the center in the lengthwise direction of the substrate.

3. The heater according to claim 1, wherein the first heat-generation line and the second heat-generation line are divided into a plurality of heat-generation blocks, and the heat-generation blocks within each heat-generation line are connected in series.

4. An image heating apparatus comprising:

an endless belt;

a heater that contacts an inner surface of the endless belt; and a nip portion forming member that forms a nip portion together with the heater via the endless belt, wherein heating is performed while sandwiching and conveying a recording material on which an image is borne in the nip portion, and wherein the heater including:

a substrate having lengthwise and widthwise dimensions;

first and second electrodes provided on the substrate at the same end of the substrate in a lengthwise direction of the substrate;

a first heat-generation line including a first electro-conductive element provided on the substrate along the lengthwise direction of the substrate, a second electro-conductive element provided on the substrate along the lengthwise direction of the substrate at a position different in a widthwise direction of the substrate from the first electro-conductive element, and a plurality of heat-generation resistors including positive resistance-temperature characteristics, and electrically connected in parallel between the first electro-conductive element and the second electro-conductive element;

a second heat-generation line including a third electro-conductive element provided on the substrate along the lengthwise direction of the substrate, a fourth electro-conductive element provided on the substrate along the lengthwise direction of the substrate at a position different in the widthwise direction of the substrate from the third electro-conductive element, and a plurality of heat-generation resistors including positive resistance-temperature characteristics and electrically connected in parallel between the third electro-conductive element and the fourth electro-conductive element, and a fifth electro-conductive element provided on the substrate, wherein the second electro-conductive element and the third electro-conductive element are arranged between the first electro-conductive element and the fourth electro-conductive element in the widthwise direction of the substrate, wherein the fifth electro-conductive element is arranged between the second electro-conductive element and the third electro-conductive element in the widthwise direction of the substrate, wherein the first electrode is connected to the first electro-conductive element and the fourth electro-conductive element, wherein the second electrode is connected to the fifth electro-conductive element, wherein the second electro-conductive element and the third electro-conductive element are connected to the fifth electro-conductive element, and wherein the first heat-generation line and the second heat-generation line are provided along the lengthwise direction of the substrate at positions different in the widthwise direction of the substrate from each other, and the first heat-generation line and the second heat-generation line are electrically connected in parallel.

5. The image heating apparatus according to claim 4, wherein the first and second heat-generation lines satisfy at least either one of conditions that heat-generation resistors arranged at end portions of each heat-generation line have higher resistance values than the heat-generation resistors arranged at the center in the lengthwise direction of the substrate, or the distance between adjacent heat-generation resistors included in one heat-generation line are wider at end portions than at the center in the lengthwise direction of the substrate.

6. The image heating apparatus according to claim 4, wherein the first heat-generation line and the second heat-generation line are divided into a plurality of heat-generation blocks, and the heat-generation blocks within each heat-generation line are connected in series.

* * * * *